US005234008A

United States Patent [19]

Fagg

[11] Patent Number: 5,234,008

[45] Date of Patent: * Aug. 10, 1993

[54] TOBACCO PROCESSING

[75] Inventor: Barry S. Fagg, Winston-Salem, N.C.

[73] Assignee: R. J. Reynolds Tobacco Company, Winston-Salem, N.C.

[ * ] Notice: The portion of the term of this patent subsequent to Jul. 21, 2009 has been disclaimed.

[21] Appl. No.: 792,123

[22] Filed: Nov. 14, 1991

Related U.S. Application Data

[63] Continuation-in-part of Ser. No. 484,587, Feb. 23, 1990, Pat. No. 5,065,775, and a continuation-in-part of Ser. No. 720,308, Jun. 25, 1991, Pat. No. 5,131,414.

[51] Int. Cl.[5] ..... A24B 15/24; A24B 15/26

[52] U.S. Cl. ..... 131/297; 131/298

[58] Field of Search ..... 131/297, 298, 310, 352, 131/356

[56] References Cited

U.S. PATENT DOCUMENTS

| | | |
|---|---|---|
| 678,362 | 7/1901 | Froehling . |
| 802,487 | 10/1905 | Wimmer . |
| 1,196,184 | 8/1916 | Villiers-Stuart . |
| 1,294,310 | 2/1919 | Sayre et al. . |
| 1,949,012 | 2/1934 | Frank . |
| 2,128,043 | 8/1938 | Garner . |
| 2,227,863 | 1/1941 | Rhodes . |
| 2,582,075 | 1/1952 | Severi . |
| 2,770,239 | 11/1956 | Prats et al. . |
| 2,805,667 | 9/1957 | Von Bethmann . |
| 2,822,306 | 2/1958 | Thienemann et al. . |
| 3,046,997 | 7/1962 | Hind . |
| 3,096,773 | 7/1963 | Neukomm et al. . |
| 3,139,435 | 6/1964 | Staley et al. . |
| 3,390,685 | 7/1968 | Von Bethmann et al. . |
| 3,396,735 | 8/1968 | Von Bethmann et al. . |
| 3,561,451 | 2/1971 | Jacin et al. . |
| 4,068,671 | 1/1978 | Casey . |
| 4,153,063 | 5/1979 | Roselius et al. . |
| 4,744,375 | 5/1988 | Denier et al. . |
| 4,962,774 | 10/1990 | Thomasson et al. . |
| 5,025,812 | 6/1991 | Fagg et al. . |
| 5,065,775 | 11/1991 | Fagg ..... 131/297 |
| 5,131,414 | 7/1992 | Fagg ..... 131/297 |

FOREIGN PATENT DOCUMENTS

| | | |
|---|---|---|
| 0280817 | 9/1988 | European Pat. Off. . |
| 0323699 | 7/1989 | European Pat. Off. . |

*Primary Examiner*—V. Millen
*Assistant Examiner*—William M. Pierce

[57] ABSTRACT

Tobacco cut filler is processed to have a controlled extract content. The processed cut filler is provided by (i) providing an aqueous tobacco extract, (ii) providing tobacco cut filler which has been extracted with an aqueous liquid, (iii) contacting the aqueous extract with the extracted cut filler, (iv) deliquoring the mixture of aqueous extract and extracted cut filler such that a certain level of the tobacco extract remains in contact with the extracted cut filler, and (v) drying the deliquored cut filler to provide a processed cut filler. As such, tobacco cut filler can be processed so as to have higher or lower levels of tobacco extractables therein, as compared to that of the tobacco cut filler prior to processing.

38 Claims, 3 Drawing Sheets

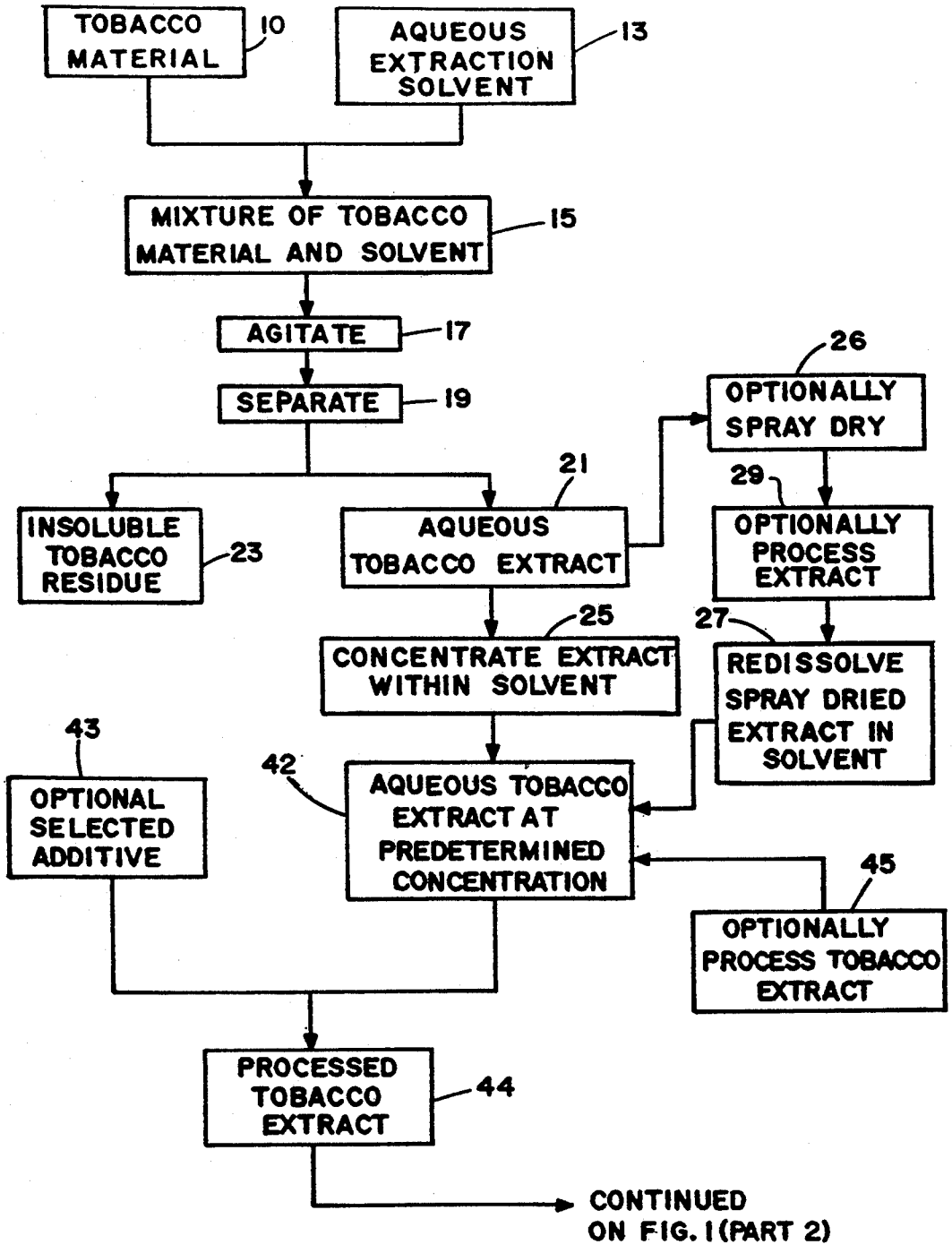
FIG. 1 (PART 1)

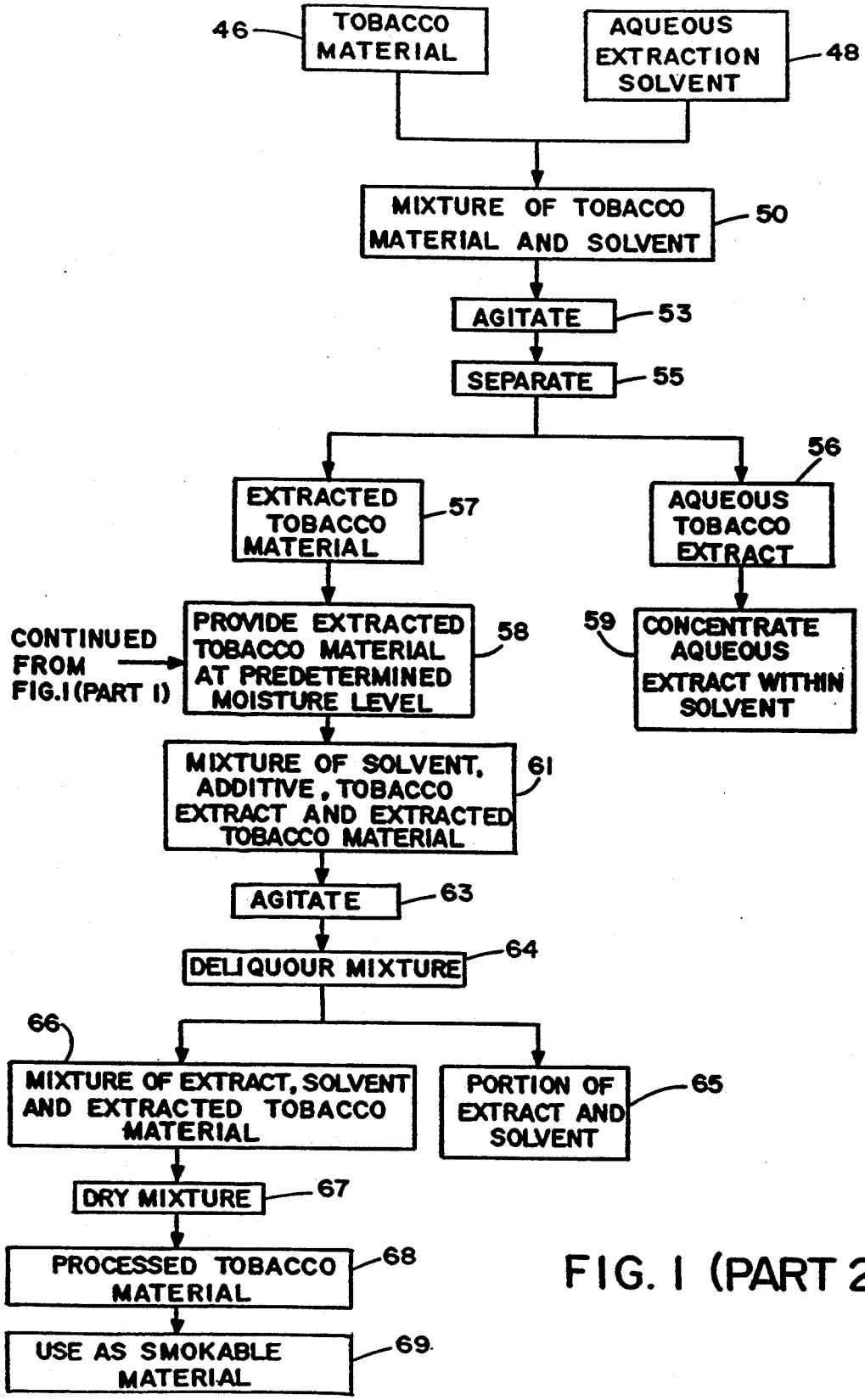
FIG. 1 (PART 2)

TOBACCO PROCESSING

CROSS-REFERENCE TO RELATED APPLICATION

This is a continuation-in-part of U.S. patent application Ser. Nos. 484,587 filed Feb. 23, 1990, now U.S. Pat. No. 5,065,775 and 720,308 filed Jun. 25, 1991, now U.S. Pat. No. 5,131,414 the disclosures of which are incorporated herein by reference.

BACKGROUND OF THE INVENTION

The present invention relates to tobacco, and in particular to a process for altering the character of a tobacco material.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material.

Tobacco undergoes various processing steps prior to the time that it is used for cigarette manufacture. Oftentimes, tobacco is chemically or physically treated to modify flavor and smoking characteristics thereof, or flavorful additives are contacted with the tobacco. For example, it may be desirable to process a tobacco material such that predetermined amounts of selected components are present within the tobacco material.

It would be desirable to provide a process for efficiently and effectively altering the chemical nature or composition of tobacco, and in particular to provide a process for controlling the composition of a tobacco material.

SUMMARY OF THE INVENTION

The present invention relates to a process for altering, in a controlled manner, the character of a tobacco material. In particular, the process involves removing and then redistributing certain components of a tobacco material within that tobacco material, often without changing many of the physical characteristics of the tobacco material to a significant degree. In one preferred embodiment, the process involves altering the chemical nature of a tobacco material (e.g., by adding at least one selected substance to a tobacco material, and/or by removing at least one selected component from that tobacco material).

In one aspect, the process of the present invention involves providing extracted tobacco material by extracting tobacco material using an extraction solvent. The extracted tobacco material is the portion of the tobacco material insoluble in the solvent, and that material is separated from the solvent and tobacco extract extracted by the solvent. The process also involves providing a tobacco extract by extracting tobacco material using an extraction solvent. If desired, the chemical composition of the tobacco extract then can be altered so as to provide a processed tobacco extract. The processed tobacco extract can be provided by adding at least one selected substance to the extract and/or by removing at least one selected tobacco component from the extract. The tobacco extract, optional additive, extraction solvent and extracted tobacco material are contacted with one another in a controlled manner. Normally, the tobacco extract and additive are provided within extraction solvent; and the extract, additive and solvent are contacted with the extracted tobacco material. As such, there is provided a resulting mixture of (i) solvent, (ii) tobacco extract, (iii) additive, and (iv) extracted tobacco material. The weight of the solvent within the mixture is more than 3 times that of the weight of the extracted tobacco material within the mixture. The extracted tobacco material is separated from some of the tobacco extract, additive and solvent along with a predetermined portion of the tobacco extract, additive and solvent; and the resulting mixture of solvent, additive, tobacco extractables and extracted tobacco material normally has a solvent content of at least about 60 percent, based on the total weight of the mixture. At least a portion of the solvent then is separated from the resulting mixture. As such, there is provided a processed tobacco material. The processed tobacco material includes a predetermined, controlled amount of tobacco extract in intimate contact with the extracted tobacco material.

In another aspect, the process of the present invention involves providing extracted tobacco material and tobacco extract, as described previously. The process also involves contacting the tobacco extract, optional additive, extraction solvent and extracted tobacco material with one another in order to provide a mixture of (i) solvent, (ii) tobacco extract, (iii) optional additive, and (iv) extracted tobacco material. The mixture can include an amount of extract having a weight greater than, less than or equal to that weight of the extract previously separated from the tobacco material. The mixture normally includes about 5 to about 40 percent tobacco extractables (e.g., tobacco extract), based on the total weight of tobacco extractables and solvent within the mixture. The weight of the solvent within the mixture normally is at least 3 times that of the weight of the extracted tobacco material within the mixture. The extracted tobacco material is separated from some of the tobacco extract, additive and solvent along with a predetermined portion of the tobacco extract, optional additive, and solvent; and the resulting mixture of solvent, tobacco extractables, optional additive and extracted tobacco material normally has a solvent content of about 60 to about 90 percent, based on the total weight of the mixture. At least a portion of the solvent then is separated from the resulting mixture. As such, there is provided a processed tobacco material having a predetermined, controlled amount of extract in intimate contact with the extracted tobacco material.

The process steps of the present invention preferably further involve extracting a yet further amount of tobacco material using extraction solvent, to provide a yet further amount of extracted tobacco material and a further amount of tobacco extract within the solvent. In the preferred embodiment, the chemical composition of the further amount of tobacco extract is altered so as to provide a processed extract; and the processed extract is contacted with the tobacco extract and solvent separated from the previously processed extracted tobacco material. The resulting processed tobacco extract within extraction solvent then is contacted with the yet further amount of extracted tobacco material to provide a mixture of (i) solvent, (ii) tobacco extract, (iii) optional additive, and (iv) extracted tobacco material. Such mixture includes solvent, optional additive, tobacco extractables and extracted tobacco material in amounts which have been set forth previously. As such, the process steps can continue in order to alter the chemical composition of an indefinite amount (i.e., an indefinite number of lots) of tobacco material.

The present invention, in one specific aspect, relates to a process for providing a predetermined level of tobacco solubles within a tobacco material. Such a process involves providing an extracted tobacco material by extracting tobacco material with an extraction solvent having an aqueous character (e.g., water), and separating the tobacco material insoluble in the solvent from the resulting aqueous tobacco extract. The process also can involve providing a processed tobacco extract by contacting an aqueous tobacco extract with an additive or otherwise altering the character of the extract. The processed tobacco extract is provided within a predetermined amount of extraction solvent and contacted with extracted tobacco material. As such, there is provided a slurry of an aqueous tobacco extract and a water insoluble tobacco material. The slurry normally includes about 5 to about 40 percent tobacco extract (i.e., tobacco extractables), based on the total weight of the solvent and tobacco extract within the slurry. The water insoluble tobacco material is separated from a predetermined portion of the solvent and tobacco extract (i.e., the slurry is "deliquored" to remove a certain amount of aqueous tobacco extract from the insoluble portion while providing a moist mixture of insoluble tobacco material and tobacco extract). Then, at least a portion of the extraction solvent is separated from the deliquored portion (i.e., the moist mixture of water insoluble tobacco material and tobacco extract is dried to a desired moisture level). Normally, the level of tobacco extract within extraction solvent is such that, when the slurry is deliquored, a predetermined amount of tobacco extract and optional additive remains in contact with the insoluble tobacco material so that, when dried to the desired moisture level, the resulting mixture of tobacco extract and insoluble tobacco material has a dry weight which reflects a predetermined amount of extract and a predetermined amount of extracted tobacco.

The process of the present invention provides the skilled artisan with an efficient and effective method for changing the character of a tobacco material (e.g., rearranging components of a tobacco material as well as altering the chemical nature or composition of a tobacco material) in a controlled manner. That is, the process of the present invention can be employed in a way such that changes in the chemical composition of tobacco as well as the physical characteristics of tobacco can be monitored so as to occur to a desired degree. Preferably, the process involves (i) providing controlled amounts of tobacco extract in intimate contact with an extracted tobacco material, or (ii) both removing selected substances from a tobacco material and providing selected substances in intimate contact with that tobacco material, or (iii) providing a processed tobacco material having an extract content less than, equal to or greater than that of the tobacco material prior to treatment using the process of the present invention.

BRIEF DESCRIPTION OF THE DRAWINGS

FIG. 1, which consists of two parts, is a schematic diagram of the process steps representative of one embodiment of the present invention.

DETAILED DESCRIPTION OF THE PREFERRED EMBODIMENTS

Figure 2:
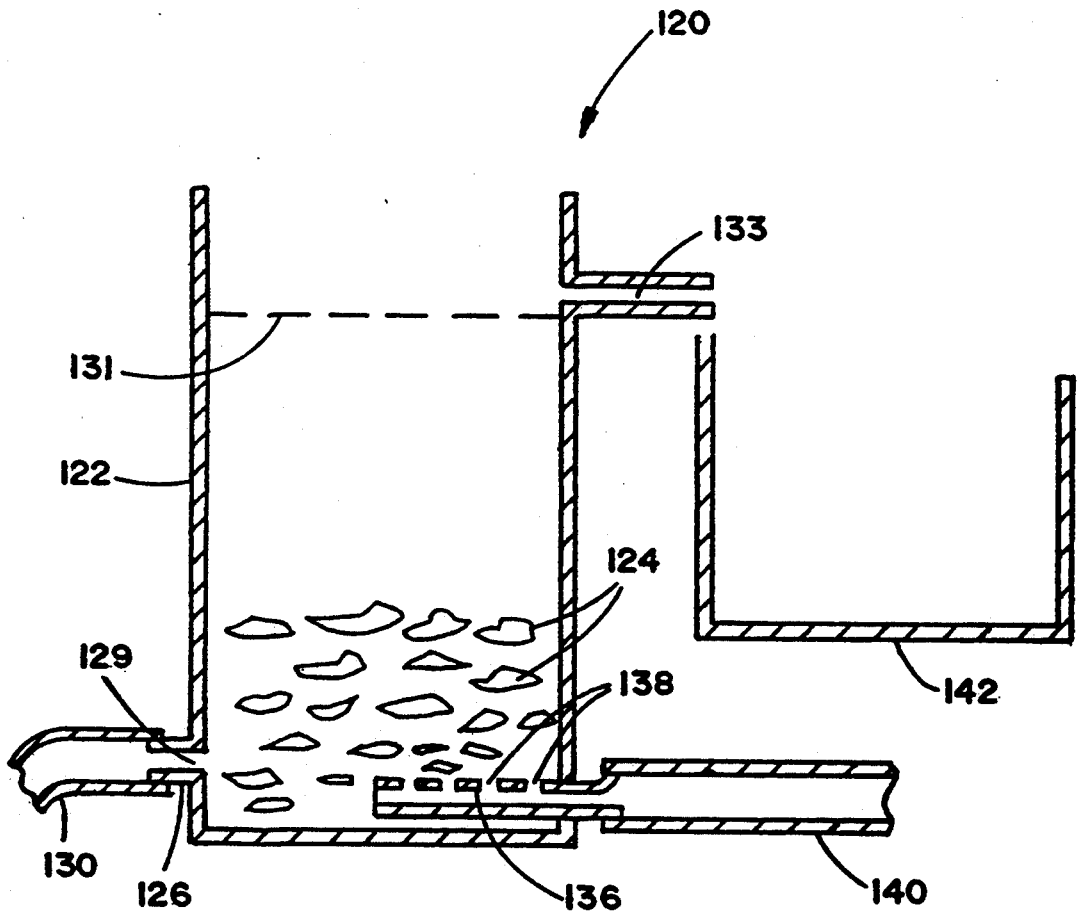
FIG. 2 is a cross-sectional view of a representative apparatus for performing certain process steps of the present invention.

Referring to FIG. 1, tobacco material 10, such as tobacco dust, cut filler or strip, is contacted with an aqueous extraction solvent 13. Contact can be performed in either a continuous or batch-wise manner. The mixture 15 of tobacco material 10 and extraction solvent 13 can be agitated 17 in order to enhance removal of water soluble components from the tobacco material. The mixture 15 is subjected to separation conditions 19 (e.g., using a ram press, a twin disk press or a centrifuge) so as to provide an aqueous tobacco extract 21 (i.e., a water soluble tobacco extract within the extraction solvent), and a water insoluble tobacco residue 23. Optionally, the aqueous tobacco extract 21 is concentrated 25 to an appropriate dissolved tobacco solids level using a thin film evaporator, or the like. Furthermore, the aqueous tobacco extract optionally can be spray dried 26 for handling reasons, and then redissolved in water 27 for further processing steps. Optionally, at least one selected additive can be physically blended with the spray dried extract to provide a mixture; and/or the spray dried extract can be processed 29 so as to remove at least one selected substance therefrom.

The tobacco extract is contacted with sufficient aqueous extraction solvent so as to provide an aqueous tobacco extract 42 having a predetermined dissolved tobacco solids level. In the event that the dried extract is contacted with additive to provide a mixture, that mixture is contacted with solvent so as to provide additive dispersed in an aqueous tobacco extract. A particularly preferred amount of extract within an aqueous extraction solvent is an amount which ranges from about 15 to about 25 weight percent extract (e.g., dissolved tobacco solids), based on the total weight of the tobacco extract and solvent.

At least one additive 43 optionally is contacted with the tobacco extract to provide a processed tobacco extract 44, particularly if an additive previously has not been combined with the extract. Alternatively, the tobacco extract can be processed 45 so as to remove at least one selected substance therefrom. If desired, the extract can be processed so as to remove at least one selected substance therefrom, and then be combined with an additive.

A further amount (i.e., a new lot) of tobacco material 46, such as tobacco cut filler or strip, is contacted with an aqueous extraction solvent 48. Contact can be performed in either a continuous or batch-wise manner. The mixture 50 of tobacco material 46 and extraction solvent 48 can be agitated 53 in order to tobacco material. The mixture 50 is subjected to separation conditions 55 (e.g., using a ram, a twin disk press or a centrifuge) so as to provide an aqueous tobacco extract 56 and an extracted tobacco material 57 (e.g., a water insoluble tobacco residue). The extracted tobacco material 57 can be provided at a predetermined moisture level 58 by deliquoring the mixture to a predetermined degree and- /or by drying moist extracted tobacco material which has been separated from a substantial portion of the aqueous tobacco extract. Optionally, the aqueous tobacco extract 56 is concentrated to an appropriate dissolved tobacco solids level 59.

The extracted tobacco material 57, which has a very low content of tobacco water solubles (i.e., tobacco extractables) then is contacted with the processed aqueous extract 44 so as to provide a mixture 61 (e.g., slurry) of tobacco extract, additive, solvent and tobacco material insoluble in the solvent. The aqueous tobacco extract of the resulting mixture 61 includes components of the tobacco extract and components of the extracted tobacco material 57. Normally, the weight of the solvent within the mixture 61 is more than about 10 times that weight of the extracted tobacco material within the mixture. The mixture 61 of extracted tobacco material, extract (i.e., extractables), optional additive and extraction solvent can be agitated 63 in order to enhance uniform contact of water soluble tobacco extract components and additive with the extracted tobacco material (e.g., to provide an equilibrium or equilibration of the extract and extracted tobacco material), while preferably minimizing physical degradation of the water insoluble extracted tobacco material.

Contact of the mixture 61 of extract, optional additive, extracted tobacco material and solvent is effected until the extract has had sufficient contact time with the extracted tobacco material. For example, in a batch process, the amount of extract and solvent is sufficiently great relative to the extracted tobacco material such that the extracted tobacco material is provided with the ability to experience fairly uniform contact with the extract.

After contact of the mixture 61 of tobacco material, extract, optional additive and solvent is complete, the mixture is deliquored 64. For example, the mixture is squeezed or pressed to remove a certain portion 65 of the certain amount of additive therefrom. The resulting moist mixture of extract, additive and water insoluble tobacco material 66 is such that the dry weight thereof is essentially equal to that of the dry weight of the tobacco material 45 prior to processing steps of the present invention minus the weight of the tobacco components which may have been removed therefrom plus the weight of additives and tobacco components (e.g., in extract form) which are added thereto.

The deliquored tobacco material is subjected to a drying operation 67 so as to yield a tobacco material 68 having a moisture content of about 10 to about 15 weight percent. The resulting processed tobacco material 68 has a controlled amount of tobacco extractables in contact with the extracted tobacco material. Typical processed tobacco materials have greater than about 10 percent to less than about 65 percent solvent soluble (e.g., water soluble) tobacco extractables in intimate contact with the water insoluble extracted tobacco material, based on the dry weight of the processed tobacco material. The resulting tobacco material 68 is used as smokable material 69 for the manufacture of cigarettes. For example, the tobacco material can be cased, top dressed, further processed or treated (e.g., volume expanded), screened to provide material of the desired size, and/or blended with other smokable materials.

Referring to FIG. 2, there is shown an apparatus 120 for performing certain process steps of the present invention. Container 122 has side walls and a bottom wall, and contains tobacco material 124 to be extracted. Into bottom feed port 126 is fed a solvent having an aqueous character 129, which in turn, contacts the tobacco material 124. The solvent is fed from a reservoir (not shown) through tube 130 (shown as cut away) using a suitable pump (not shown). Screen 131 is positioned over the tobacco material but below exit port 133 in order to prevent insoluble tobacco material from exiting the container. A tube or plenium 136 having a plurality of perforations 138 therein is connected to air line 140 (shown as cut away) from an air source (not shown) to provide agitation by a bubbling action to the mixture (i.e., slurry) of tobacco material and solvent. As such, the tobacco material 124 is subjected to contact with the solvent under extraction conditions. Aqueous tobacco extract which exits the exit port 133 is collected in reservoir 142 (not shown to scale), is later processed, and can be used for later contact with an extracted tobacco material. If desired, several apparatus 120 can be provided in series so that aqueous tobacco extract exiting one container containing tobacco material can be contacted with tobacco material in another container.

The apparatus 120 provides a convenient means for continuously contacting a supply of an aqueous solvent with a sample of tobacco material. In particular, solvent can be continuously passed through container 122 containing tobacco material 124 at a desired rate until the resulting mixture of aqueous tobacco extract and tobacco material exhibits a desirably low tobacco extract content. Then, the resulting extracted tobacco material can be removed from the container (i.e., the extracted tobacco material is separated from the aqueous tobacco extract). Alternatively, the apparatus 120 can be employed to provide a batch-wise contact of a solvent with a sample of tobacco material. In particular, solvent can be recirculated through the container 122 containing a suitable amount of tobacco material 124.

The tobacco material which is processed according to the process of the present invention can vary. The tobacco materials which are used are of a form such that, under extraction conditions, a portion thereof is soluble in (i.e., extracted by) the extraction solvent and a portion thereof is insoluble in (i.e., not extracted by) the extraction solvent. Examples of types of suitable tobacco materials include flue-cured, Burley, Md., and Oriental tobaccos, as well as the rare or specialty tobaccos. Normally, the tobacco material has been aged. The tobacco material can be in the form of laminae and/or stem, or can be in a processed form. For example, the tobacco material can be in the form of whole leaf, strip, cut filler, shredded stem, processed stem, volume expanded tobacco filler, reconstituted strip or filler, or tobacco previously extracted to a certain degree. Tobacco waste materials and processing by-products (e.g., scrap and dust) also can be employed. The aforementioned tobacco materials can be processed separately, or as blends thereof.

The tobacco material can have a variety of sizes for extraction. The tobacco material most preferably is in strip form or cut filler form. Tobacco materials in strip or cut filler form, or shredded stem form, are desirable in that the ultimately processed tobacco materials are employed as such for the manufacture of cigarettes. Tobacco scrap, stems and dust also can be extracted according to the process of the present invention, and the resulting processed tobacco material can be formed into a predetermined (e.g., sheet-like) shape, thus providing a reconstituted tobacco material.

The tobacco material is contacted with an extraction solvent. A highly preferred extraction solvent is a solvent having an aqueous character. Such a solvent consists primarily of water, is normally greater than 90 weight percent water, and can be essentially pure water in certain circumstances. Essentially pure water can include deionized water, distilled water or tap water. The extraction solvent can be a co-solvent mixture, such as a mixture of water and minor amounts of one or more solvents which are miscible therewith. An example of such a co-solvent mixture is a solvent consisting of 95 weight parts water and 5 weight parts ethanol. The extraction solvent also can include water having substances such as pH adjusters (i.e., acids or bases) or pH buffers dissolved therein. For example, an aqueous solvent can have ammonium hydroxide or gaseous ammonia incorporated therein so as to provide a solvent having a pH of about 8 or more.

The amount of tobacco material which is contacted with the extraction solvent can vary. Typically, for a batch-wise extraction, the weight of extraction solvent relative to the tobacco material is greater than about 6:1, oftentimes greater than about 8:1 and in certain instances greater than about 12:1. The amount of solvent relative to tobacco material depends upon factors such as the type of solvent, the temperature at which the extraction is performed, the type or form of tobacco material which is extracted, the manner in which contact of the tobacco material and solvent is conducted, the type of extraction process which is performed, and other such factors. The manner for contacting the tobacco material with the extraction solvent is not particularly critical, and as such, the tobacco material can be extracted in either a continuous or batch-wise manner. For example, the tobacco material can be extracted using a continuous counter current extractor, such as the type described in U.S. Pat. No. 4,363,264 to Lang, et al.; and *Food Engineering*, pp. 151–154 (May, 1986); and is available as CCE Model No. 500, Model No. 1000 or Model No. 1200 from Counter Current Technology Pty. Ltd.

A preferred continuous counter current extractor is employed in a counter rotating manner; and positioned such that tobacco material fed into one end of the extractor travels at a slight upward incline relative to horizontal, and solvent travels at a slight downward incline relative to horizontal during extraction conditions. See, U.S. patent application Ser. No. 733,477, filed Jul. 22, 1991, which is incorporated herein by reference.

Tobacco material can be extracted in a batch-wise manner one or more times using the solvent. Normally, the weight of extract and solvent relative to the weight of tobacco material for each batch extraction ranges from about 6:1 to about 40:1, preferably from about 15:1 to about 25:1. The number of times that the tobacco material is contacted batch-wise with the processed tobacco extract and solvent ranges from about 1 to about 8 times, preferably about 3 to about 5 times. For example, tobacco material in cut filler form can be contacted batch-wise at ambient temperature (i.e., about 22° C.) with three successive portions of an aqueous solvent, and the resulting mixture is subjected to a deliquoring step to provide a moist mixture of insoluble tobacco material and tobacco extract of about 78 weight percent after contact of each successive portion is complete; and after the third deliquoring step, the moist tobacco material can be dried to a moisture level of about 10 to about 15 weight percent so as to provide a tobacco cut filler having undergone a reduction in water soluble tobacco components of about 96 weight percent.

Tobacco material can be extracted continuously using a solvent. Normally, the weight of solvent relative to the tobacco material with which it is contacted during a preferably greater than about 50:1.

The conditions under which the extraction is performed can vary. Typical temperatures range from about 5° C. to about 75° C., with about 10° C. to about 60° C. being preferred, about 15° C. to about 35° C. being more preferred, and ambient temperature being particularly preferred. The solvent/tobacco material mixture can be agitated (e.g., stirred, shaken or otherwise mixed) in order to increase the rate at which extraction occurs. Typically, for a batch-wise extraction, adequate extraction of components occurs in less than about 60 minutes, oftentimes in less than about 30 minutes.

A wide variety of components can be extracted from the tobacco materials. The particular components and the amounts of the particular components which are extracted often depend upon the type of tobacco which is processed, the properties of the particular solvent, and the extraction conditions (e.g., which include the temperature at which the extraction occurs as well as the time period over which an extraction is carried out). For example, an extraction solvent consisting essentially of pure water will most often extract primarily the water soluble components of the tobacco material, while a co-solvent mixture of water and a minor amount of an alcohol can extract the water soluble components of the tobacco material as well as certain amounts of tobacco substances having other solubility characteristics. Water soluble tobacco components which are extracted from a tobacco material using a solvent having an aqueous character include alkaloids, acids, salts, sugars, and the like. Water soluble extracted tobacco components include many of the flavorful substances of the tobacco material.

The extraction solvent and tobacco extract then are separated from the insoluble tobacco residue. The manner of separation can vary; however, it is convenient to employ conventional separation techniques involving the use of filters, centrifuges, screw presses, ram air presses, converging belts, rotating disk presses, and the like. Preferably, the insoluble residue is treated so as to remove a predetermined amount of solvent and tobacco extract therefrom. The insoluble residue provided during the collection of the extract is not necessarily used in further stages of the process, and may be discarded.

The solvent and tobacco components extracted thereby can be filtered to remove suspended insoluble particles; concentrated; diluted with solvent; or spray dried, storage or handling reasons. Dried extracts, such as spray dried tobacco extracts, can be later redissolved in extraction solvent for later treatment and further extraction process steps.

The chemical composition of the tobacco extract can be altered so as to provide a processed extract. In particular, an additive can be contacted with the tobacco extract. A variety of techniques can be employed to alter to a further degree the chemical composition of the tobacco extract. The tobacco extract can be processed to remove nicotine, nitrates or other such components therefrom (e.g., as set forth in U.S. Pat. Nos. 4,967,771 to Fagg, et al. and 5,065,775 to Fagg); or provided within solvent and subjected to membrane treatment to remove certain soluble or dispersible components (e.g., as set forth in U.S. Pat. No. 4,941,484 to Clapp, et al.). If desired, a tobacco extract within extraction solvent can be subjected to ion exchange, absorption or further extraction treatments. In a preferred aspect, an aqueous tobacco extract is subjected (i) to liquid/liquid extraction processing steps, (ii) to supercritical extraction processing steps, as described in European Patent Application No. 338,831, which is incorporated herein by reference, or (iii) to further treatment as set forth in U.S. Pat. No. 5,005,593 to Fagg, which is incorporated herein by reference. Methods for removing nitrates from tobacco extracts (e.g., for removing potassium nitrate from a Burley extract) will be apparent to the skilled artisan. See, U.S. Pat. No. 4,131,117 to Kite, et al., and U.S. patent application Ser. No. 753,508, filed Sept. 3, 1991. If desired, the tobacco extract can be heat treated in order to alter its chemical composition or combined with other tobacco extracts. See, U.S. Pat. No. 5,060,669 to White, et al., and U.S. patent application Ser. No. 710,273, filed Jun. 4, 1991, which are incorporated herein by reference. Normally, removal of substances from the extract and heat treatment of the extract are provided prior to the time that additives are contacted with the extract.

The additive can include a material which is not soluble to a significant degree in the extraction solvent. For example, when the extraction solvent is a liquid having an aqueous character, the additive is a material which is essentially insoluble in that solvent. As used herein, the term "essentially insoluble" means that the additive does not dissolve in the solvent to a significant degree; or if the additive is a liquid, is essentially immiscible with the solvent. Typically, when the solvent has an aqueous character, such additives have solubilities in water at 25° C. of less than about 5 percent by weight, usually less than about 3 percent by weight, and frequently less than about 1 percent by weight. Exemplary essentially water insoluble additives include (i) oils, and particularly essential oils, such as peppermint, spearmint, nutmeg and coriander oils; (ii) particulate, fibrous, powder and crystalline materials, such as St. John's bread powder, cocoa powder and processed flavors in dry powder form, menthol crystals, vanillin crystals, sorbic acid crystals, ellagic acid crystals, heliotropin crystals, flavor and aroma chemicals (e.g., geraniol, phenylethyl alcohol, benzylcinnamate and methyl heptenone), powdered carbonaceous materials, inorganic powders (e.g., particulates of calcium sulfate and calcium carbonate) and inorganic fibers (e.g., Franklin Fiber available from U.S. Gypsum Corp. in the form of A-30, A-45, H-30, H-45 and P-1); (iii) plant exudates and waxy resins, such as Peru balsam; (iv) semi-solid, viscous plant extracts, such as fenugreek; (v) absolutes (e.g., osmanthus); and (vi) concretes (e.g., oakmoss).

The manner in which the tobacco extract is contacted with the additive can vary. Typically, particulate, powdery and crystalline materials can be dispersed within the tobacco extract and solvent using suitable types of agitation. Similarly, liquid, waxy or viscous materials can be dispersed within the tobacco extract and solvent. If desired, a crystalline additive (e.g., menthol) can be dissolved in a suitable solvent therefor (e.g., propylene glycol), and the resulting solution can be dispersed in an aqueous tobacco extract. If desired, a tobacco extract in an essentially solvent free form (e.g., a spray dried extract) can be contacted (e.g., physically mixed) with the additive (e.g., menthol crystals), and the resulting mixture can be contacted with the solvent aqueous tobacco extract having menthol crystals dispersed therein.

The additive can include a material which is soluble in or miscible with the extraction solvent. The additive can include casing materials (e.g., licorice, glycerin or propylene glycol), top dressing materials, organic acids (e.g., citric, ascorbic, malic, tartaric, lactic, acetic, levulinic, adipic, succinic or malonic acids), monoammonium phosphate, diammonium phosphate, ammonia, potassium sorbate, sugars (e.g., sucrose, dextrose, glucose or fructose), amino acids, hydrolyzed amino acids, metal ions (e.g., types and amounts sufficient to alter the combustion properties of the ultimate processed tobacco material), sodium alginate, ammonium alginate, or combinations thereof. The types and amounts of additives which are incorporated into a particular tobacco extract can vary, depending upon the desired nature of the ultimate tobacco material which is processed, and the types and amounts of additives employed can be determined by experimentation. For example, in excess of about 5 percent but normally less than about 20 percent of the dry weight of the ultimate processed tobacco material can be provided by a humectant (e.g., glycerin). If desired, certain components can be removed from the tobacco extract and certain selected additives can be incorporated into the tobacco extract.

The amount of additive relative to the extract can vary. The amount of additive depends upon factors such as the flavor and aroma characteristics of the ultimate processed tobacco material. As such, the amount of a particular additive which is provided in intimate contact with the ultimate processed tobacco material can be determined by experimentation, and such a determination can be made readily by one having ordinary skill in providing flavored or processed tobacco materials.

The processed tobacco extract is provided within extraction solvent. As such, a further amount of extraction solvent can be added to the processed tobacco extract, or the processed tobacco extract within extraction solvent can be concentrated. Normally, a predetermined amount of processed tobacco extract (i.e., dissolved tobacco solids) is provided within extraction solvent. The predetermined amount of tobacco extract is such that, when the contact of extracted tobacco material with the tobacco extract and solvent is complete, and a portion of the solvent and tobacco extract is separated therefrom, a predetermined portion of the solvent and tobacco portion of the extracted tobacco material.

A processed extract within extraction solvent (e.g., an aqueous tobacco extract) normally is provided such that the dissolved tobacco solids within the ultimate mixture of extract, additive, solvent and tobacco material insoluble in the solvent are more than about 4 percent, usually between about 5 and about 40 percent, preferably between about 8 and about 34 percent, more preferably between about 10 and about 30 percent, most preferably between about 15 and about 25 percent, based on the total weight of the tobacco extractables and solvent. Such an aqueous extract can be contacted with extracted tobacco material, and the insoluble portion of the tobacco material can be deliquored to provide a moist mixture of insoluble extracted tobacco material and tobacco extract having a moisture content of about 60 to about 90 weight percent, preferably about 65 to about 85 weight percent. For example, an aqueous tobacco extract can be contacted with extracted tobacco material, and the resulting slurry having a dissolved tobacco solids content of about 18 weight percent is deliquored to a moisture level of about 70 weight percent in order to provide, upon drying (i.e., after removal of moisture), a tobacco material having desirable levels of both water insoluble and water soluble tobacco components.

An extracted tobacco material is provided. Normally, the tobacco material which is extracted using extraction solvent to provide the extracted tobacco material has a form such as cut filler or strip, in order that the extracted tobacco material which is provided can be further processed according to the present invention can be employed as such for cigarette manufacture. Manners and methods for extracting tobacco materials are set forth herein before. The tobacco material which is extracted can be one type of tobacco material or a blend of various types of tobacco materials. The extracted tobacco material is the tobacco residue which is not soluble in (i.e., not extracted by) the extraction solvent. Preferably, the tobacco material is subjected to extraction conditions in the presence of sufficient extraction solvent and under conditions sufficient to provide an extracted tobacco material having a high level of the tobacco extractables removed from the tobacco material. The extracted tobacco material is separated from the solvent and tobacco extract to provide an extracted tobacco material having a low level of tobacco extractables. The extracted tobacco material then can be employed in further processing steps of the present invention, or the extracted tobacco material can have a certain amount of the solvent removed therefrom (e.g., the extracted material can be dried, when the solvent has an aqueous character) prior to being employed in further processing steps of the present invention.

If desired, the physical and/or chemical composition of the extracted tobacco material can be altered. The extracted tobacco material can be reformed, cut to a desired size or shape, or otherwise physically altered, particularly when the extracted tobacco material is in a fairly moist form. The extracted tobacco material can be heat treated or otherwise processed to change the chemical composition of that material. In particular, the extracted tobacco material can be subjected to enzyme treatment as set forth in U.S. Pat. No. 4,887,618 to Bernasek, et al., reacted with certain agents or further extracted (e.g., an extracted tobacco material provided from an extraction of a tobacco material with an aqueous solvent can be subjected to extraction conditions using a hydrophobic solvent, such as hexane). If desired, the extracted tobacco material can be combined with another material which is essentially insoluble in the extraction solvent (e.g., the extracted tobacco material can be combined with a non-tobacco cellulosic material, such as fibers of softwood pulp, fibers of hardwood pulp, cotton fibers, kapok fibers, pieces of corn husks, and the like).

The tobacco extract, additive and extraction solvent are contacted with the extracted tobacco material. Contact of the extract, optional additive and the extraction solvent with the extracted tobacco material can be carried out using the container described previously with reference to FIG. 2, a continuous countercurrent extractor, or other suitable means. As such, the additive as well as components of the tobacco extract contact the tobacco material insoluble in the extraction solvent. If desired, the tobacco extract can be provided from one type of tobacco, and the extracted tobacco. For example, a tobacco extract obtained by extracting flue-cured tobacco cut filler or a blend of tobaccos in cut filler form using water can be applied to Burley tobacco stems which have previously been extracted using water. Normally, tobacco extract components include those substances which are soluble or otherwise dissolve in the solvent, or are highly dispersible within the solvent. During such contact, there exists a dynamic state whereby tobacco components soluble or dispersible in the solvent become dispersed throughout the mixture to some degree. Typically, such contact is performed within a temperature range of about 5° C. to about 75° C., with about 10° C. to about 60° C. being preferred, about 15° C. to about 35° C .being more preferred, and ambient temperature being particularly preferred. Contact conditions are maintained until adequate contact of the extract with the insoluble tobacco material occurs (e.g., there is provided fairly uniform contact of the extract components and additive with the insoluble tobacco material). As such, the components of the extract are well distributed or re-established within the insoluble tobacco material.

If desired, the contact of the extracted tobacco material with the extract, optional additive and extraction solvent can be performed continuously using the type of apparatus described in U.S. Pat. No. 4,363,264 to Lang, et al.; *Food Engineering*, pp. 151–154 (May, 1986). Such an apparatus is employed in a counter rotating manner, preferably in a counter current manner such that extracted tobacco material introduced at one end of the apparatus is contacted with solvent, extract and additive which is introduced at the other end of the apparatus. Preferably, the apparatus is positioned such that the tobacco material travels at a slight upward incline during re-equilibration of the extracted tobacco material with extract. See, U.S. patent application Ser. No. 733,477, filed Jul. 22, 1991.

The extracted tobacco material is contacted with an amount of extract, optional additive and solvent such that not all of that extract, additive and solvent remains in contact with the extracted tobacco material when the final tobacco material is provided. Typically, the weight of solvent contacted with the extracted tobacco material is at least 3 times, frequently at least about 6 times, often at least about 10 times and preferably at least about 15 times that weight of extracted tobacco material within the mixture of solvent, extract, optional additive and extracted tobacco The extracted tobacco material which has been contacted with the processed tobacco extract, optional additive and extraction solvent is separated from a portion of the tobacco extract and solvent (e.g., the mixture is deliquored). As such, there is provided a mixture of extraction solvent, extract, additive and tobacco material insoluble in the solvent (e.g., a moist mixture of extract and water insoluble tobacco material, when the solvent is water). The tobacco material insoluble in the solvent can vary, depending upon the solvent and extraction conditions. However, for a solvent having an aqueous character, a typical insoluble tobacco material includes components of the biopolymer matrix of the tobacco (e.g., cellulosics) and other tobacco materials which are not dissolved in the solvent or are not otherwise extracted by the solvent. For purposes of the present invention, insoluble materials are tobacco components not extracted by the particular solvent which is employed under the selected extraction conditions.

Typical deliquoring processes or steps involve using converging belts, centrifuges, screw presses, rotating disk presses, ram air presses, or the like. Typically, the deliquored mixture of tobacco extractables, optional additive and insoluble extracted material has a solvent content of about 60 to about 90 weight percent, preferably about 65 to about 85 weight percent; particularly when the weight of the solvent within the mixture prior to the deliquoring step is more than about 10 times that weight of the extracted tobacco material within that mixture. The deliquored mixture of tobacco extractables, additive and insoluble extracted tobacco material can be dried using hot air columns, apron dryers, microwave dryers, or the like. Typically, deliquored tobacco material is dried to a moisture level of about 10 to about 15 weight percent, preferably about 12 to about 13 weight percent.

The processed tobacco material, which has had a desired amount of solvent removed therefrom, can be further processed prior to the time that it is used for the manufacture of cigarettes or other smoking articles. In particular, processed tobacco material in strip form and having a fairly high moisture content can be shredded into cut filler form using known techniques, and then dried for further use. The processed tobacco material can be volume expanded using known techniques, particularly when the processed tobacco material is in cut filler form. For example, the processed tobacco material in cut filler form, which has been processed so as to be in intimate contact with a sugar or ammonium alginate additive, can be subjected to volume expansion conditions including the use of heat and/or steam. The processed tobacco material can be subjected to reconstitution processing steps (e.g., using known papermaking, cast sheet or extrusion techniques), particularly when the processed tobacco material is in the form of dust, fines, stem and/or scrap. The processed tobacco material can be cased, top dressed, or otherwise treated in order to alter further the flavor or material then can be used as the smokable filler material for the manufacture of cigarettes, or blended with other smokable materials for the manufacture of cigarettes.

The processed tobacco material includes a solvent insoluble portion and a controlled level of solvent soluble extractables in intimate contact therewith. As such, the processed tobacco material can have a relatively high filling capacity due to an insoluble portion having a lower level of tobacco extractables in intimate contact therewith, as compared to the starting tobacco material prior to processing. In addition, the processed tobacco material can have a highly flavorful smoking character due to an insoluble portion having a higher level of flavorful tobacco extractables in intimate contact therewith, as compared to the starting tobacco material prior to processing. Also of particular interest is a process whereby a flavorful tobacco extract from one type of tobacco material (e.g., as is provided from a blend of flavorful tobaccos) is applied to an extracted tobacco pulp of another tobacco material (e.g., aqueously extracted Burley tobacco stems). Processed tobacco materials typically have greater than about 10 percent, usually greater than about 20 percent, often greater than about 30 percent, and frequently greater than about 40 percent, solvent soluble tobacco extractables in intimate contact with the solvent insoluble (i.e., extracted) tobacco material, based on the final dry weight of the processed tobacco material. Processed tobacco materials typically have less than about 65 percent, usually less than about 60 percent, and often less than about 55 percent, solvent soluble tobacco extractables in intimate contact with the solvent insoluble (i.e., extracted) tobacco material, based on the final dry weight of the processed tobacco material. Often, processed tobacco materials can have about 45 percent to about 52 percent solvent soluble tobacco extractables in intimate contact with the solvent insoluble (i.e., extracted) tobacco material, based on the final dry weight of the processed tobacco material. When the processed materials have a depleted level of solvent soluble tobacco extractables, such processed tobacco material typically have less than about 90 percent, usually have less than about 80 percent, and sometimes have less than about 70 percent of the level of solvent soluble tobacco extractables in intimate contact with the solvent insoluble (i.e., extracted) tobacco material, relative to the level of solvent soluble tobacco extractables originally present in the tobacco material used to provide the extracted tobacco material. When the processed tobacco materials have an increased level of solvent soluble tobacco extractables, such processed tobacco materials typically have more than about 105 percent, usually have more than about 110 percent, and sometimes have more than about 115 percent of the level of solvent soluble tobacco extractables in intimate contact with the solvent insoluble (i.e., extracted) tobacco material, relative to the level of solvent soluble tobacco extractables originally present in the tobacco material used to provide the extracted tobacco material.

Tobacco extract and extraction solvent which are contacted with the extracted tobacco material (i.e., the extract and solvent separated from the tobacco material, including the portion separated during the deliquoring step) are collected. Although not necessary, the extract so collected can be processed to remove certain substance(s) therefrom, have certain additives applied thereto, and/or provided at a desired dissolved solids level with extraction solvent. If desired, further solvent and further processed extract can be incorporated into the extract and solvent which is collected, in order to provide a tobacco extract and solvent mixture having a desired, predetermined tobacco extract level. As such, a processed extract is regenerated for use in altering the chemical composition of a further lot of extracted tobacco material.

The following examples are provided in order to further illustrate various embodiments of the invention, but should not be construed as limiting the scope thereof. Unless otherwise noted, all parts and percentages are by weight.

EXAMPLE 1

A process for producing a tobacco material having a selected solubles content is performed as follows:

An aged blend of 49.25 parts flue-cured, 28.5 parts Burley and 22.25 parts Oriental tobaccos, in cut filler form shredded at 25 cuts per inch, and having a dry weight nicotine content of about 2.5 percent and a dry weight water soluble portion of about 50 percent, is divided into lots or portions. One lot is retained for later use. The other lot is extracted continuously using tap water heated to about 60° C. The tobacco material is extracted using a continuous counter current extractor available as CCE Model No. 1000 from Counter Current Technology Pty. Ltd., using techniques generally as described in U.S. patent application Ser. No. 733,477, filed Jul. 22, 1991. A liquid extract is continuously collected after extraction, and has a solvent content of about 10 percent and an extract content of about 10 percent. The extraction is carried out in such a way that greater than about 90 percent of the water extractables are removed from the tobacco material.

The aqueous extract is concentrated in a thin film evaporator to a concentration of about 30 percent dissolved solids. Thin film evaporation conditions are such that water is evaporated from the extract while loss of tobacco volatiles is minimized. The concentrated aqueous extract then is spray dried by continuously pumping the aqueous solution to an Anhydro spray dryer. The dried powder is collected at the outlet of the dryer. The inlet temperature of the spray dryer is about 200° C., and the outlet temperature is about 90° C.

The spray dried tobacco extract is a brown, powdery material, and has a moisture content of about 5 percent or less, and a nicotine content of about 5 percent. Spray drying allows the tobacco extract to be stored for further use.

Another lot (i.e., the retained portion) of the tobacco cut filler blend is placed into the container shown generally in FIG. 2. The container has the shape of a cylinder having a closed bottom and a top which is open to the atmosphere. The container is about 24 inches high and about 18 inches in diameter. A solvent inlet port is positioned along the peripheral face of the container near the bottom of the container, and an extract/solvent exit port is positioned along the peripheral face of the container about 20 inches from the bottom of the container. A mesh wire screen having a 0.5 mm particle retention is positioned just below the exit port. A small tube having pinhole perforations is positioned along the bottom of the container just below the inlet port. The tube is attached to a laboratory air line.

About 10 gallons of tap water is provided at ambient temperature and is introduced into the container containing about 3,500 g of the cut filler. The cut filler has a moisture content of about 10 percent. Then, a further amount of the tap water is provided at ambient temperature and is introduced into the container at a 1 gallon per minute rate, for about a 1 hour period. The liquid solvent is introduced into the container using a tap pressure. As such, a total of at least about 60 parts solvent are contacted under ambient conditions with about 1 part cut filler. During contact of the solvent and cut filler, air is bubbled through the pinholes in the small tube into the mixture to effect good turbulence (e.g., and hence mixing) of the mixture, while minimizing degradation of the tobacco cut filler. Air is bubbled through the mixture at such a rate that the mixture appears to be simmering. As such, greater than about 95 percent of available water soluble tobacco components are leached from the tobacco material, and transported out of the container through the exit port.

The processed insoluble tobacco material is removed from the container, and a portion of the aqueous phase is removed therefrom using a ram air press. As such, there is provided a damp, extracted tobacco cut filler having a moisture content of about 75 percent and a predominantly insoluble tobacco material content of about 25 percent. The container then is emptied for further use.

Into the container shown generally in FIG. 2 and described previously in this Example, is charged about 27,474 g tap water at about 45° C., about 442 g glycerin, and about 4,319 g of the spray dried extract. The mixture is agitated for about 15 minutes by bubbling air therethrough. Then, the damp, extracted tobacco cut filler, which weighs about 6,273 g, is added to the container. The resulting slurry is agitated for about 1 hour by bubbling air through the pinholes in the small tube of the container into the slurry to effect good turbulence of the slurry, while minimizing degradation of the cut filler.

The cut filler is removed from the container, and a portion of the aqueous tobacco extract which is in contact with the insoluble tobacco material is removed therefrom using a ram air press. As such, there is provided a damp, processed, deliquored cut filler having a moisture content of about 68 percent, a water solubles tobacco extract content of about 10 percent, and an insoluble tobacco material content of about 22 percent. The damp, processed cut filler weighs about 7,076 g. The deliquored cut filler (e.g., a moist cake) is passed three times through a hot air column set at about 300° F. to dry the cut filler to a moisture level of about 15 percent. The cut filler then is air dried at ambient conditions to a moisture level of about 12 percent. The cut filler includes extracted tobacco material in intimate contact with tobacco extractables.

The tobacco filler so provided has a tobacco extract water solubles content of about 40 percent and a nicotine content of about 1.2 percent, on a dry weight basis. The tobacco filler so processed is used as cut filler in cigarette manufacture. The general physical character of the processed filler is similar to that of the starting tobacco filler which is divided into lots.

EXAMPLE 2

A process for producing a tobacco material having a controlled extract content is performed as follows:

An aged blend of flue-cured, Burley and Oriental tobaccos in cut filler form as described in Example 1 is provided. A portion of the cut filler is extracted, and the extract is spray dried, as described in Example 1, to provide a spray dried extract.

The retained (i.e., unextracted) portion of cut filler, weighing about 2,270 g, is placed into the container shown generally in FIG. 2 and described in Example 1. The cut filler is extracted with water in the manner described in Example 1.

The processed insoluble tobacco material is removed from the container, and a portion of the aqueous phase which is in contact with the insoluble tobacco material is removed therefrom using a ram air press. As such, there is provided a damp, extracted tobacco cut filler having a moisture content of about 78 percent and a predominantly insoluble tobacco material content of about 22 percent. The container then is emptied for further use.

Into the container is shown generally in FIG. 2 and described previously, is charged about 17,000 g tap water at about 45° C., about 222 g glycerin, and about 6,450 g of the spray dried extract. The mixture is agitated for about 15 minutes by bubbling air therethrough. Then, the damp, extracted tobacco cut filler, which weighs about 4,560 g, is added to the container. The resulting slurry is agitated for about 1 hour by bubbling air through the pinholes in the small tube of the container into the slurry to effect good turbulence of the slurry, while minimizing degradation of the cut filler.

The cut filler is removed from the container, and a portion of the aqueous tobacco extract which is in contact with the insoluble tobacco material is removed therefrom using a ram air press. As such, there is provided a damp, processed, deliquored cut filler having a moisture content of about 65 percent, a tobacco extract water solubles content of about 20 percent, and an insoluble tobacco material content of about 15 percent. The damp, processed cut filler weighs about 6,521 g. The deliquored cut filler (e.g., a moist cake) is passed three times through a hot air column set at about 300° F. to dry the cut filler to a moisture level of about 15 percent. The cut filler then is air dried at ambient conditions to a moisture level of about 12 percent. The cut filler includes extracted tobacco material in intimate contact with tobacco extractables.

The tobacco filler so provided has a tobacco extract water solubles content of about 55 percent, and a nicotine content of about 2.5 percent, on a dry weight basis. The tobacco filler so processed is used as cut filler in cigarette manufacture. The general physical character of the processed filler is similar to that of the starting tobacco filler which is divided into lots.

EXAMPLE 3

A process for providing a tobacco material having a selected extract content is performed as follows:

An aged blend of flue-cured, Burley and Oriental tobaccos in cut filler form as described in Example 1 is provided. A portion of the cut filler is extracted and spray dried, as described in Example 1, to provide a retained spray dried extract.

A portion of the spray dried extract then is contacted with warm tap water in the amount of about 18 parts extract to about 78 parts tap water. The resulting aqueous tobacco extract, which exhibits a pH of about 5, is filtered to remove suspended particulate matter therefrom. To the solution is added a sufficient amount of a solution of aqueous ammonium hydroxide to provide an aqueous tobacco extract exhibiting a pH of about 10. The nicotine content of the aqueous tobacco extract so provided is about 0.8 percent.

A Karr Reciprocating Plate Extraction Column is provided. The column is a Model KC-1-8-XE-SS from Chem-Pro Corp., Fairfield, N.J. The column includes a glass tube having a length of about 2.44 m and an inner diameter of about 2.54 cm. Through the column extends a shaft having a diameter of about 6 mm. On the shaft is positioned about 48 generally circular extraction plates at about 5 cm intervals. The plates are manufactured from stainless steel, have a thickness of about 1.6 mm, have a diameter of slightly less than 5 cm, and have the shape and configuration shown generally in FIG. 3 of U.S. Pat. No. 4,967,771 to Fagg, et al. The movement of the shaft is controlled at a reciprocation of about 200 strokes per minute and a reciprocation amplitude of 1.3 cm by a variable speed drive agitator positioned above the column.

Into the lower input region of the column is fed the aqueous tobacco extract at a rate of about 16.8 pounds per hour. Into the upper input region of the column is fed CFC 11 at a rate of about 25.2 pounds per hour. Feed of each of the aqueous tobacco extract and the CFC 11 is provided by air driven gear pumps. The CFC 11 and the aqueous tobacco extract each are chilled to about 10° C. prior to introduction into the column, in order to prevent the CFC 11 from boiling. In addition, a water cooled coil which surrounds the column maintains the column at a temperature of about 17° C. to about 20° C. The aqueous tobacco extract and the CFC 11 are subjected to a countercurrent extraction process.

The aqueous tobacco extract is removed from the column at the upper output region, and collected in a stainless steel reservoir. The CFC 11 is removed from the column at the lower output region, and is collected in a stainless steel reservoir.

The nicotine content of the aqueous tobacco extract so collected is less than about 0.01 percent. By difference, the nicotine extraction efficiency is above 98 percent. Such resulting denicotinized aqueous tobacco extract then is spray dried in a manner similar to the spray drying process described in Example 1. As such, a substantial quantity of water and essentially all of the ammonia provided as the added ammonium hydroxide are separated from the denicotinized tobacco extract. A dry denicotinized spray dried tobacco extract results.

The CFC 11 and tobacco components therein are subjected to mild distillation conditions at about 30° C., and the CFC 11 distillate is collected. A brown liquid of high viscosity and containing over 60 percent nicotine is isolated.

The retained (i.e., unextracted) portion of the cut filler, weighing about 2,500 g, is placed into the container shown generally in FIG. 4 and described in Example 1. The cut filler is extracted with water in the manner described in Example 1.

The processed insoluble tobacco material is removed from the container, and a portion of the aqueous phase which is in contact with the insoluble tobacco material is removed therefrom using a ram air press. As such, there is provided a damp, extracted tobacco cut filler having a moisture content of about 78 percent and a predominantly insoluble tobacco material content of about 22 percent. The container is emptied for further use.

Into the container is shown generally in FIG. 2 and described previously, is charged about 17,503 g tap water at about 45° C., about 1,855 g denicotinized spray dried extract, about 220 g glycerin, and about 1,280 g of the retained spray dried extract. The mixture is agitated for about 15 minutes by bubbling air therethrough. Then, the damp, extracted tobacco cut filler, which weighs about 4,975 g, is added to the container. The resulting slurry is agitated for about 1 hour by bubbling air through the pinholes in the small tube of the container into the slurry to effect good turbulence of the slurry, while minimizing degradation of the cut filler.

The cut filler is removed from the container, and a portion of the aqueous tobacco extract which is in contact with the insoluble tobacco material is removed therefrom using a ram air press. As such, there is provided a damp, processed, deliquored cut filler having a moisture content of about 74 percent, a water solubles tobacco extract content of about 11 percent, and an insoluble tobacco material content of about 15 percent. The damp, processed cut filler weighs about 7,550 g.

The deliquored cut filler (e.g., a moist cake) is passed three times through a hot air column set at about 300° F. to dry the cut filler to a moisture level of about 15 percent. The cut filler then is air dried at ambient conditions to a moisture level of about 12 percent. The cut filler includes extracted tobacco material in intimate contact with tobacco extractables.

The tobacco filler so provided has tobacco extract water solubles content of about 42 percent, and a nicotine content of about 0.8 percent, on a dry weight basis. The tobacco filler so processed is used as cut filler in cigarette manufacture. The general physical character of the processed filler is similar to that of

EXAMPLE 4

A process for producing a tobacco material having a controlled extract content is performed as follows:

An aged blend of flue-cured, Burley and Oriental tobaccos in cut filler form as described in Example 1 is provided. A portion of the cut filler is extracted, and the extract is spray dried, as described in Example 1, to provide a retained spray dried extract. A denicotinized spray dried extract is provided, as described in Example 3.

The retained portion of cut filler, weighing about 2,500 g, is placed into the container shown generally in FIG. 2 and described in Example 1. The cut filler is extracted with water in the manner described in Example 1.

The processed insoluble tobacco material is removed from the container, and a portion of the aqueous phase which is in contact with the insoluble tobacco material is removed therefrom using a ram air press. As such, there is provided a damp, extracted tobacco cut filler having a moisture content of about 78 percent and a predominantly insoluble tobacco material content of about 22 percent. The container then is emptied for further use.

Into the container is shown generally in FIG. 2 and described previously, is charged about 17,503 g tap water at about 45° C., about 3,990 g denicotinized spray dried extract, about 314 g glycerin, and about 1,818 g of the retained spray dried extract. The mixture is agitated for about 15 minutes by bubbling air therethrough. Then, the damp, extracted tobacco cut filler, which weighs about 4,940 g, is added to the container. The resulting slurry is agitated for about 1 hour by bubbling air through the pinholes in the small tube of the container into the slurry to effect good turbulence of the slurry, while minimizing degradation of the cut filler.

The cut filler is removed from the container, and a portion of the aqueous tobacco extract which is in contact with the insoluble tobacco material is removed therefrom using a ram air press. As such, there is provided a damp, processed, deliquored cut filler having a moisture content of about 67 percent, a water solubles tobacco extract content of about 18 percent, and an insoluble tobacco material content of about 15 percent. The damp, processed cut filler weighs about 7,448 g. The deliquored cut filler (e.g., a moist cake) is passed three times through a hot air column set at about 300° F. to dry the cut filler to a moisture level of about 15 percent. The cut filler then is air dried at ambient conditions to a moisture level of about 12 percent. The tobacco filler includes extracted tobacco material in intimate contact with tobacco extractables.

The tobacco filler so provided has a water solubles tobacco extract content of about 54 percent, and a nicotine content of about 0.8 percent, on a dry weight basis. The tobacco filler so processed is used as cut filler in cigarette manufacture. The general physical character of the processed filler is similar to that of the starting tobacco filler which is divided into lots.

EXAMPLE 5

A process for providing a tobacco material having a selected tobacco extract of certain types of tobaccos applied to tobacco stems is performed as follows:

An aged blend of flue-cured, Burley and Oriental tobaccos in cut filler form as described in Example 1 is provided. A portion of the cut filler is extracted and spray dried, as described in Example 1, to provide a spray dried extract.

Cut Burley tobacco stems, weighing about 3,500 g, are placed into the container shown generally in FIG. 4 and described in Example 1. The stems are extracted with water in the manner described in Example 1.

The processed insoluble tobacco material is removed from the container, and a portion of the aqueous phase which is in contact with the insoluble tobacco material is removed therefrom using a ram air press. As such, there are provided damp, extracted tobacco stem pieces having a moisture content of about 76 percent and a predominantly insoluble tobacco material content of about 24 percent. The container is emptied for further use.

Into the container is shown generally in FIG. 2 and described previously, is charged about 20,000 g tap water at about 45° C., about 87 g glycerin, and about 3,600 g spray dried extract. The mixture is agitated for about 15 minutes by bubbling air therethrough. Then, the damp, extracted tobacco stem pieces, which weighs about 8,000 g, is added to the container. The resulting slurry is agitated for about 1 hour by bubbling air through the pinholes in the small tube of the container into the slurry to effect good turbulence of the slurry, while minimizing degradation of the stem pieces.

The tobacco pieces are removed from the container, and a portion of the aqueous tobacco extract which is in contact with the insoluble tobacco material is removed therefrom using a ram air press. As such, there are provided damp, processed, deliquored tobacco stems having a moisture content of about 75 percent, a water solubles tobacco extract content of about 10 percent, and an insoluble tobacco material content of about 15 percent. The damp, processed tobacco material weighs about 13,000 g. The deliquored tobacco stems (e.g., a moist cake) is passed three times through a hot air column set at about 300° F. to dry the tobacco material to a moisture level of about 15 percent. The tobacco material then is air dried at ambient conditions to a moisture level of about 12 tobacco stem pieces in intimate contact with tobacco extractables.

The processed tobacco stems so provided have an extract content of about 40 percent, and a nicotine content of about 1.9 percent, on a dry weight basis. The tobacco material so processed is used as a cut filler component in cigarette manufacture.

EXAMPLE 6

A process for producing a tobacco material having a selected tobacco extract of certain types of tobaccos applied to tobacco cut filler of other types of tobaccos is performed as follows:

An aged blend of flue-cured tobacco stems and "American blend" scrap tobacco materials is provided. The blend is extracted, and the extract is spray dried, essentially as described in Example 1, to provide a spray dried extract.

A tobacco cut filler blend as described in Example 1, weighing about 3,500 g, is placed into the container shown generally in FIG. 2 and described in Example 1. The cut filler is extracted with water in the manner described in Example 1.

The processed insoluble tobacco material is removed from the container, and a portion of the aqueous phase which is in contact with the insoluble tobacco material is removed therefrom using a ram air press. As such, there is provided a damp, extracted tobacco cut filler having a moisture content of about 78 percent and a predominantly insoluble tobacco material content of about 22 percent. The container then is emptied for further use.

Into the container is shown generally in FIG. 2 and described previously, is charged about 24,000 g tap water at about 45° C., about 3,400 g of the spray dried extract described previously in this Example, about 445 g glycerin, and about 5,750 g of the spray dried extract described in Example 1. The mixture is agitated for about 15 minutes by bubbling air therethrough. Then, the damp, extracted tobacco cut filler, which weighs about 7,100 g, is added to the container. The resulting slurry is agitated for about 1 hour by bubbling air through the pinholes in the small tube of the container into the slurry to effect good turbulence of the slurry, while minimizing degradation of the cut filler.

The cut filler is removed from the container, and a portion of the aqueous tobacco extract which is in contact with the insoluble tobacco material is removed therefrom using a ram air press. As such, there is provided a damp, processed, deliquored cut filler having a moisture content of about 66 percent, a water solubles tobacco extract content of about 21 percent, and an insoluble tobacco material content of about 13 percent. The deliquored cut filler (e.g., a moist cake) is passed three times through a hot air column set at about 300° F. to dry the cut filler to a moisture level of about 15 percent. The cut filler then is air dried at ambient conditions to a moisture level of about 12 percent. The processed tobacco filler includes extracted tobacco material in intimate contact with tobacco extractables.

The tobacco filler so provided has a water solubles tobacco extract content of about 59 percent, and a nicotine content of about 2.3 percent, on a dry weight basis. The tobacco filler so processed is used as cut filler in cigarette manufacture. The general physical character of the processed filler is similar to that of the starting tobacco filler which is divided into lots.

What is claimed is:

1. A process for controlling the composition of a tobacco material by providing a predetermined level of tobacco solubles within a tobacco material, the process comprising the steps of:

(a) providing extracted tobacco material by extracting tobacco material using a liquid extraction solvent and separating tobacco material not extracted by the solvent from the solvent and tobacco extract extracted by the solvent;

(b) providing a tobacco extract by extracting tobacco material using a liquid extraction solvent, thereby providing a tobacco extract within the extraction solvent;

(c) contacting a predetermined amount of the tobacco extract provided in step (b) within a predetermined amount of liquid extraction solvent with the extracted tobacco material provided in step (a) thereby providing a mixture of solvent, tobacco extract and extracted tobacco material; the mixture (i) including a weight of tobacco extractables greater than that weight of tobacco extract separated from the tobacco material in step (a), and (ii) including about 5 to about 40 percent extractables, based on the total weight of the solvent and tobacco extractables within the mixture;

(d) separating the extracted tobacco material from a portion of the solvent and tobacco extract, thereby providing a mixture having predetermined amounts of solvent, tobacco extract and extracted tobacco material; the mixture thereby having a solvent content ranging form about 60 to about 90 weight percent, based on the total weight thereof; and (e) separating at least a portion of the solvent form the mixture provided in step (d) so as to provide a processed tobacco material having a predetermined controlled amount of tobacco extractables in intimate contact with the extracted tobacco material, the amount ranging from greater than about 10 percent to less than about 65 percent solvent soluble tobacco extractables in intimate contact with the extracted tobacco material, based on the dry weight of the processed tobacco material.

2. The process of claim 1 whereby at least one selected substance is removed from the tobacco extract provided in step (b).

3. The process of claim 2 whereby at least one additive is incorporated into the extract provided in step (b).

4. The process of claim 1 further including altering the chemical composition of the extracted tobacco material provided in step (a) prior to step (c).

5. The process of claim 1 whereby the solvent is a liquid having an aqueous character.

6. The process of claim 5 whereby the liquid having an aqueous character is greater than about 90 weight percent water.

7. The process of claim 1 whereby the amount of tobacco extractables within the mixture provided in step (c) ranges from about 10 to about 30 percent, based on the total weight of the solvent and tobacco extractables within the mixture.

8. The process of claim 1 whereby the amount of tobacco extractables within the mixture provided in step (c) ranges from about 15 to about 25 percent, based on the total weight of the solvent and tobacco extractables within the mixture.

9. The process of claim 1 whereby the solvent content of the mixture provided in step (d) ranges from about 65 to about 85 weight percent, based on the total weight of that mixture.

10. The process of claim 1 whereby the solvent is a liquid having an aqueous character, and sufficient solvent is separated from the mixture in step (e) to provide a mixture of tobacco extract and extracted tobacco material having a solvent content between about 10 and about 15 weight percent.

11. The process of claim 1 whereby the tobacco extract is provided in an essentially solvent free form, and then is contacted with at least one additive, prior to step (c).

12. The process of claim 1 further including altering the chemical composition of the extracted tobacco material provided in step (a).

13. The process of claim 1 whereby at least one additive is contacted with the mixture provided in step (c).

14. The process of claim 1 whereby at least one additive is incorporated into the extract provided in step (b).

15. The process of claim 13 or 14 whereby the solvent is a liquid having an aqueous character and additive includes glycerin, and in excess of about 5 percent but less than about 20 percent of the processed tobacco material, on a dry weight basis, is provided by the additive.

16. The process of claim 1 whereby the processed tobacco material, on a dry weight basis, includes less than about 90 percent of the solvent soluble tobacco extractables present in the tobacco material used for providing the extracted tobacco material.

17. The process of claim 1 whereby the processed tobacco material, on a dry weight basis, includes less than about 80 percent of the solvent soluble tobacco extractables present in the tobacco material used for providing the extracted tobacco material.

18. The process of claim 1 whereby the processed tobacco material, on a dry weight basis, includes less than about 70 percent of the solvent soluble tobacco extractables present in the tobacco material used for providing the extracted tobacco material.

19. The process of claim 1 whereby the processed tobacco material, on a dry weight basis, includes more than about 105 percent of the solvent soluble tobacco extractables present in the tobacco material used for providing the extracted tobacco material.

20. The process of claim 1 whereby the processed tobacco material, on a dry weight basis, includes more than about 110 percent of the solvent soluble tobacco extractables present in the tobacco material used for providing the extracted tobacco material.

21. A process for controlling the composition of tobacco material by providing a predetermined level of tobacco solubles within a tobacco material, the process comprising the steps of:

(a) providing extracted tobacco material by extracting tobacco material using a liquid extraction solvent and separating tobacco material not extracted by the solvent form the solvent and tobacco extract extracted by the solvent;

(b) providing a tobacco extract by extracting tobacco material using a liquid extraction solvent, thereby providing a tobacco extract within the extraction solvent;

(c) contacting a predetermined amount of the tobacco extract provided in step (b) within a predetermined amount of liquid extraction solvent with the extracted tobacco material provided in step (a) thereby providing a mixture of solvent, tobacco extract and extracted tobacco material; the weight of solvent within the mixture being more than 3 times that of the weight of the extracted tobacco material within the mixture;

(d) separating the extracted tobacco material from a portion of the solvent, additive and tobacco extract, thereby providing a mixture having predetermined amounts of solvent, tobacco extract and extracted tobacco material the mixture thereby having a solvent content of at least about 60 percent, based on the total weight thereof; and (e) separating at least a portion of the solvent from the mixture provided in step (d) so as to provide a processed tobacco material having a predetermined, controlled amount of tobacco extractables in intimate contact with the extracted tobacco material, the amount ranging from a greater than about 10 percent to less than about 65 percent solvent soluble tobacco extractables in intimate contact with the extracted tobacco material, based on the dry weight of the processed tobacco material.

22. The process of claim 21 whereby the weight of the solvent within the mixture provided in step (e) is more than about 6 times that weight of the extracted tobacco material within the mixture.

23. The process of claim 21 whereby the weight of the solvent within the mixture provided in step (c) is more than about 10 times that weight of the extracted tobacco material within the mixture.

24. The process of claim 21 whereby the weight of the solvent within the mixture provided in step (c) is more than about 15 times that weight of the extracted tobacco material within the mixture.

25. The process of claim 21, 22, 23 or 24, whereby the solvent content of the mixture provided in step (d) ranges from about 60 to about 90 weight percent, based on the total weight of that mixture.

26. The process of claim 21, 22, 23 or 24 whereby the solvent is a liquid having an aqueous character.

27. The process of claim 21, 22, 23 or 24, whereby the solvent is a liquid having an aqueous character, and sufficient solvent is separated from the mixture in step (e) to provide a mixture of tobacco extract and extracted tobacco material having a solvent content between about 10 and about 15 weight percent.

28. The process of claim 21, 22, 23 or 24 whereby at least one selected substance is removed from the tobacco extract provided in step (b).

29. The process of claim 22, 23 or 24 whereby the mixture provided in step (c) includes about 5 to about 40 percent extractables, based on the total weight of the solvent and tobacco extractables within the mixture.

30. The process of claim 29 whereby the extracted tobacco material of step (a) is provided from one type of tobacco and the tobacco extract of step (b) is provided from a different type of tobacco.

31. The process of claim 21, 22, 23 or 24 whereby at least one additive is contacted with the mixture provided in step (c).

32. The process of claim 321 whereby the solvent is a liquid having an aqueous character and additive includes glycerin, and in excess of about 5 percent but less than about 20 percent of the processed tobacco material, on a dry weight basis, is provided by the additive.

33. The process of claim 21, 22, 23, or 24 whereby at least one additive is incorporated into the extract provided in step (b).

34. The process of claim 33 whereby the solvent is a liquid having an aqueous character and additive includes glycerin, and in excess of about 5 percent but less than about 20 percent of the processed tobacco material, on a dry weight basis, is provided by the additive.

35. The process of claim 21, 22, 23 or 24 whereby the processed tobacco material, on a dry weight basis, includes less than about 90 percent of the solvent soluble tobacco extractables present in the tobacco material used for providing the extracted tobacco material.

36. The process of claim 21, 22, 23 or 24 whereby the processed tobacco material, on a dry weight basis, includes less than about 80 percent of the solvent soluble tobacco extractables present in the tobacco material used for providing the extracted tobacco material.

37. The process of claim 21, 22, 23 or 24 whereby the processed tobacco material, on a dry weight basis, includes more than about 105 percent of the solvent soluble tobacco extractables present in the tobacco material used for providing the extracted tobacco material.

38. The process of claim 21, 22, 23 or 24 whereby the processed tobacco material, on a dry weight basis, includes more than about 110 percent of the solvent soluble tobacco extractables present in the tobacco material used for providing the extracted tobacco material.

* * * * *

UNITED STATES PATENT AND TRADEMARK OFFICE

CERTIFICATE OF CORRECTION

PATENT NO. : 5,234,008

DATED : August 10, 1993

INVENTOR(S) : Barry S. Fagg

It is certified that error appears in the above-indentified patent and that said Letters Patent is hereby corrected as shown below:

Col. 4, line 61, after "to", insert --enhance extraction of water soluble components from the--.

Col. 5, line 39, after "the" (first occurrence), insert --extract and solvent (i.e., aqueous extract) as well as a--.

Col. 8, line 8, after "a", insert --continuous extraction process is greater than about 40:1--.

Col. 8, line 56, after "dried" (first occurrence), insert --freeze dried, or otherwise processed, particularly for--.

Col. 10, line 51, after "tobacco" (first occurrence), insert --extract remains in contact with the insoluble tobacco--.

Col. 12, line 51, after "tobacco", insert --material.--.

Col. 13, line 41, after "or", insert --smoking characteristics thereof. The processed tobacco--.

Col. 15, line 59, after "phase", insert -- which is in contact with the insoluble tobacco material--.

Col. 19, line 2, after "of", insert --the starting tobacco filler which is divided into lots.--.

Col. 20, line 44, after "12", insert --percent. The processed tobacco stems include extracted--.

Col. 23, line 53, after "material," insert --;--.

UNITED STATES PATENT AND TRADEMARK OFFICE

CERTIFICATE OF CORRECTION

PATENT NO. : 5,234,008

DATED : August 10, 1993

INVENTOR(S) : Barry S. Fagg

It is certified that error appears in the above-indentified patent and that said Letters Patent is hereby corrected as shown below:

Column 24, line 36, "321" should read --31--.

Signed and Sealed this

Fifth Day of April, 1994

Bruce Lehman

*Attest:*

BRUCE LEHMAN

*Attesting Officer*

*Commissioner of Patents and Trademarks*